United States Patent [19]

Cameron

[11] 4,260,322

[45] Apr. 7, 1981

[54] INTEGRAL BOX SECTION BOOM ARM

[75] Inventor: Thomas M. Cameron, Waukegan, Ill.

[73] Assignee: International Harvester Company, Chicago, Ill.

[21] Appl. No.: 950,936

[22] Filed: Oct. 12, 1978

[51] Int. Cl.[3] ..... B66C 23/00; E02F 3/76; E04C 3/30

[52] U.S. Cl. ..... 414/727; 37/117.5; 52/731; 254/124; 212/261; 212/266

[58] Field of Search ..... 414/722, 727, 697, 680; 52/119, 730, 731; 37/117.5, 118 R, 118 A; 212/8 R, 8 B, 144, 200, 255, 260-261, 265, 266

[56] References Cited

U.S. PATENT DOCUMENTS

| | | | |
|---|---|---|---|
| T966,007 | 1/1978 | Liehr et al. | 414/697 X |
| 2,668,631 | 2/1954 | Reese | 37/117.5 UX |
| 3,273,299 | 9/1966 | Hartung, Jr. | 52/731 X |
| 3,722,864 | 3/1973 | Borer et al. | 254/124 |
| 4,064,947 | 12/1977 | Cole | 52/731 X |
| 4,134,507 | 1/1979 | Piercy et al. | 414/727 |
| 4,156,488 | 5/1979 | Stark | 52/731 X |
| 4,162,872 | 7/1979 | Grooss et al. | 414/727 X |

FOREIGN PATENT DOCUMENTS

| | | | |
|---|---|---|---|
| 1484978 | 5/1969 | Fed. Rep. of Germany | 52/731 |

*Primary Examiner*—Stephen G. Kunin
*Assistant Examiner*—R. B. Johnson
*Attorney, Agent, or Firm*—Douglas W. Rudy; Ronald C. Kamp; F. David AuBuchon

[57] ABSTRACT

A boom arm of a boom assembly is formed of a pair of side walls integrated into a box boom structure where the top and bottom plates are roll formed with transition edges providing a weld bed for welds attaching the side walls to the top and bottom plates. The particular cross sections of the top and bottom plates provide a weld blow-through preventing barrier and also dimensional guidance and tolerance control during assembly of the boom arm.

1 Claim, 8 Drawing Figures

10
12
14
16
20
22
24
26
30
32
34
36
40
42
44
46
50
52
56
60
62
64
66
72
74
76
80
82
84
96
102
104
4
6

INTEGRAL BOX SECTION BOOM ARM

BACKGROUND OF THE INVENTION

1. Field of the Invention

This invention is concerned with box beam boom arms for use as a boom assembly on loader vehicles. More particularly the invention is concerned with welded joints between boom arm side walls and boom arm top and bottom plates. The top and bottom plates are provided with edges formed to act as side wall locating guides, weld beds and weld blow through dams.

2. Description of the Prior Art

In boom assemblies of loader vehicles several types of constructions are used. One of the most common structures is seen in loader-backhoe vehicles that have boom arms fabricated from pairs of channel section members welded together in an edge-to-edge relationship to form a box structure of generally rectangular cross section. The channels used may also be tapered channels so that the load can be allocated toward a larger box section portion as necessary.

Another typical loader boom assembly uses a pair of massive plates of flat stock generally unified into an assembly through the use of cross ties or transverse torque tubes. Of course these plates do not require welding as they do not form box sections.

Box section boom arms constructed from a plurality of plates are also well known. Typically a pair of boom arms are utilized to make a boom assembly. Cross ties connect the inboard side walls or side plates of each arm together. Each arm is pivotally attached to the loader frame and necessary maneuvering cylinders are connected to the boom assembly at sundry locations.

The prior art boom arms have been welded using one of three typical fabrication methods. In a first technique the side plates, cut out in the proper shape, are provided with backup strips extending peripherally around the inboard sides of each of the side plates. These backup strips are set back from the outer edge of the plates a distance equivalent to the thickness of the flat plate stock top and bottom plates. Extensive forming of these relatively small backup strips, typically rectangular stock 25 mm×6 mm, is necessary to make them follow the curvalinear perimeter of the boom arm side wall plates. After the backup strips are bent to shape they are first tack welded in position and then continuously welded to the host side wall. The backup strips are not made long enough to preclude the necessity of joints between adjacent strips, hence secondary strips are welded to the backup strips to provide a continuous bead or barrier to prevent subsequent weld blow through. After the strips have been welded into position the top and bottom plates may be welded to the side walls to form the box boom arm. The top plate and the bottom plate have bevel cut edges such that the transverse dimension of the inboard side of the top plate is greater than the transverse dimension of the outboard side. The top is then welded to the pair of side plates with the weld pools filling the space defined by the straight walls of the side wall plates and the slanted walls (due to the beveled cut) of the top plate. The weld is narrow at the inner junction between the top plate and the two side walls and wider as the weld progresses outwardly. The backup strips are necessary to prevent weld blow through, but after the welding operation, are useless and unnecessary. They are not removed, however, due to the lack of accessibility. The bottom plate is welded in place in a similar manner.

The disadvantages of this first type of fabrication are:

1. The cost of positioning the blow through preventing backup strips;

2. The potential of weld blow through even with the backup strips due to slight spaces between the strips and the side wall surface or slight gaps at the butted ends of the backup strips; and 3. Distortion of the top and bottom plates as they are heated and cooled in the welding process due to differences in plate surface area due to the bevel cut edges. With the fabrication technique of this invention top and bottom plates will not have a tendency to deform as they are heated and cooled due to the slightly increased thickness of the top and the bottom plates.

Two other fabrication methods have been tried and utilized, but neither of them provide the cost and structural advantages of the instant invention. Each of the other techniques are variations of the technique described in detail above, however, in one embodiment the top plate outboard surface transverse dimension is equal to the overall width of the box boom arm structure and the inboard surface of the top plate has a transverse dimension equivalent to the wall-to-wall inside dimension of the box. The bottom plate is the same as the prior art bottom plate described above.

A third embodiment known in the prior art uses a top plate and a bottom plate having dimensional properties like the top plate as described in the second embodiment above.

All three of these embodiments are very costly due to the necessity of the backup strips to prevent weld blow through. Weld blow through may lead to poor weld penetration and a weak section in the boom assembly weldment.

The top plate and bottom plates of the instant invention are roll formed by passing a billet through a plurality of shaping and sizing dies that result in the special cross sectional shape necessary for the top plate and the bottom plate. The roll forming dies may be of a type that can be adjusted to provide slight changes in plate thickness or width as dictated by design requirements of different size boom arm assemblies. If significant dimensional changes are desired it may only be necessary to change forming dies at several of the forming stations rather than providing a whole new set of dies at a much greater cost.

Thus the primary object of this invention is to provide a box beam boom arm that is less costly to produce than state of the art box beam boom arms.

Another object of this invention is to provide a bo beam boom arm that can be welded together without the need for backup strips on the interior of the box beam.

Another object of this invention is to provide a top and bottom plate of a box beam that locates the side walls relative to each other preparatory to final welding.

Also an object of this invention is to provide a cross sectional shape for a top plate and a bottom plate that may be positioned adjacent the side walls of the structure such that different dimension weld beds are formed.

Advantageously, it has been found that several different cross sectional dimension top and bottom plates can be formed from a set of roller dies through substitution of the finishing dies of such set. Thus tooling costs for dimensionally different top and bottom plates are minimized.

Another advantage of this invention is that dishing and disfiguration of the top and bottom plates from welding and cooling operations is minimized due to the increased thickness of these plates over prior art plates coupled with good weld containment through the use of these top plate and bottom plates.

SUMMARY OF THE INVENTION

The invention is a boom arm assembly for use on a loader vehicle wherein each boom arm is an integral box section structure having side walls formed of flat plates and top and bottom plates formed from roll formed billets that have a cross sectional shape such that when mated to the side wall members form a J-groove weld bed. The top and bottom plates provide a built in width fixture and a welding blow through dam.

BRIEF DESCRIPTION OF THE DRAWING FIGURES

DETAILED DESCRIPTION OF THE INVENTION

Figures 1, 2, 6, 7:
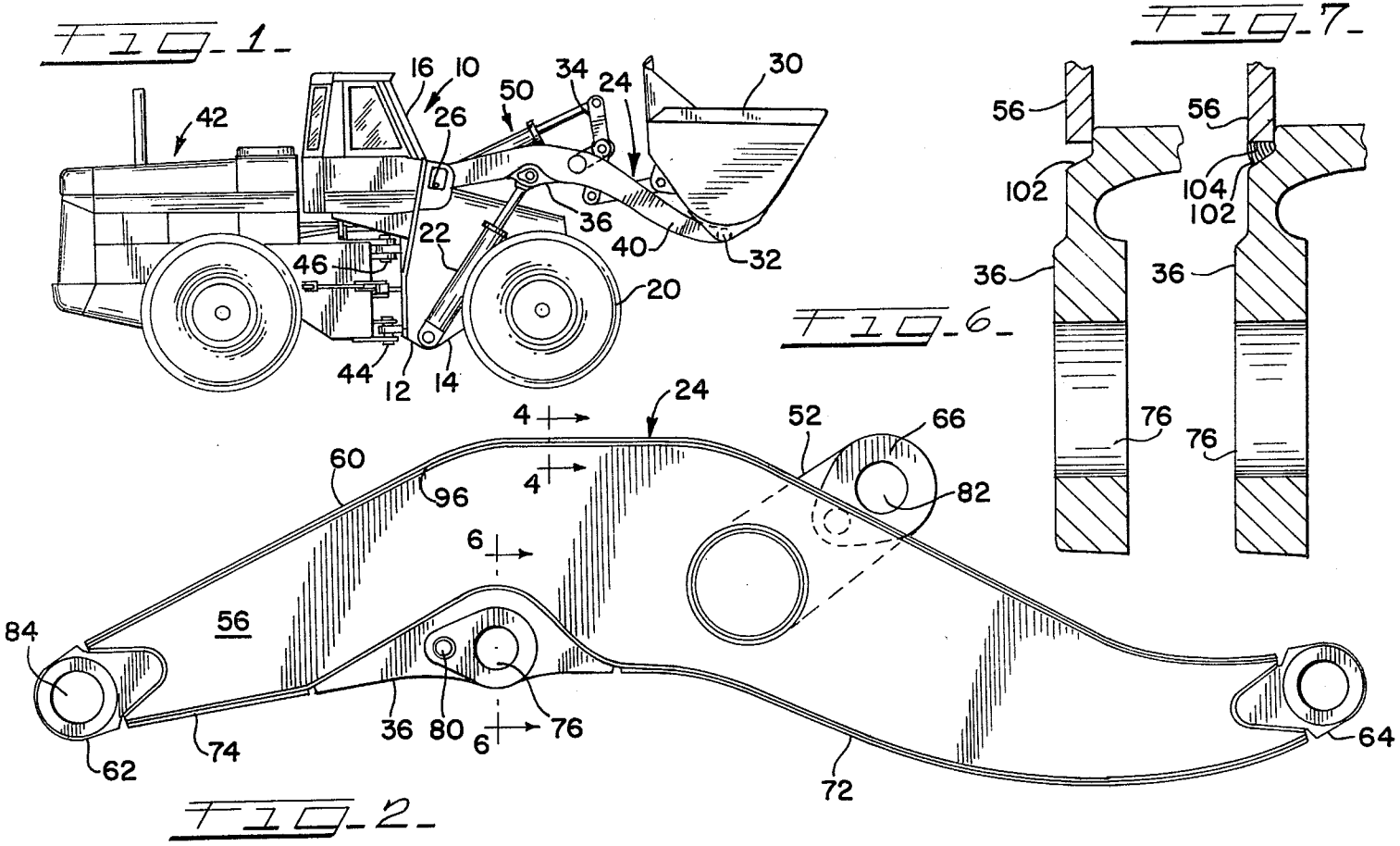
FIG. 1 is an elevation view of an articulated loader incorporating boom arms as detailed in this disclosure.
FIG. 2 is an elevation view of a loader boom incorporating the invention prior to welding the components together.
FIG. 6 is a cross sectional view of a portion of a casting integrated into the boom arm assembly taken through plane 6—6 of FIG. 2.
FIG. 7 is a representation of the same section as shown in FIG. 6 after welding.

The boom arm assembly and its method of fabrication can best be understood when considered in its typical environment as shown by a mobile material handling vehicle namely the rubber tired articulated loader generally 10 shown in FIG. 1. This loader incorporates a front section 12 including a frame 14, a cab 16, a wheel such as 20 on each side of the frame 14, a front section boom arm or boom lifting cylinder such as 22 pivotally mounted on each side of the front section frame 14, a boom assembly generally 24 pivotally mounted to the front section frame at pivot point 26, a bucket 30 pivotally mounted to the boom assembly at pivot point 32 and bucket articulation linkage 34 pivotally mounted to the front section frame and to a bell crank pivotally carried by the boom assembly generally 24. The boom lifting cylinders 22 are each pivotally mounted to a boom pocket casting 36 incorporated in each boom arm, one shown as 40 of the boom arm assembly generally 24.

The rear section generally 42 houses the vehicle engine and is supported by a pair of driving wheels in a conventional manner. The loader is articulated around a vertical pivot axis as defined by hinge pins 44 and 46. The front wheels as well as the rear wheels may both be driven through a state of the art drive train.

Figures 3, 4, 5, 8:
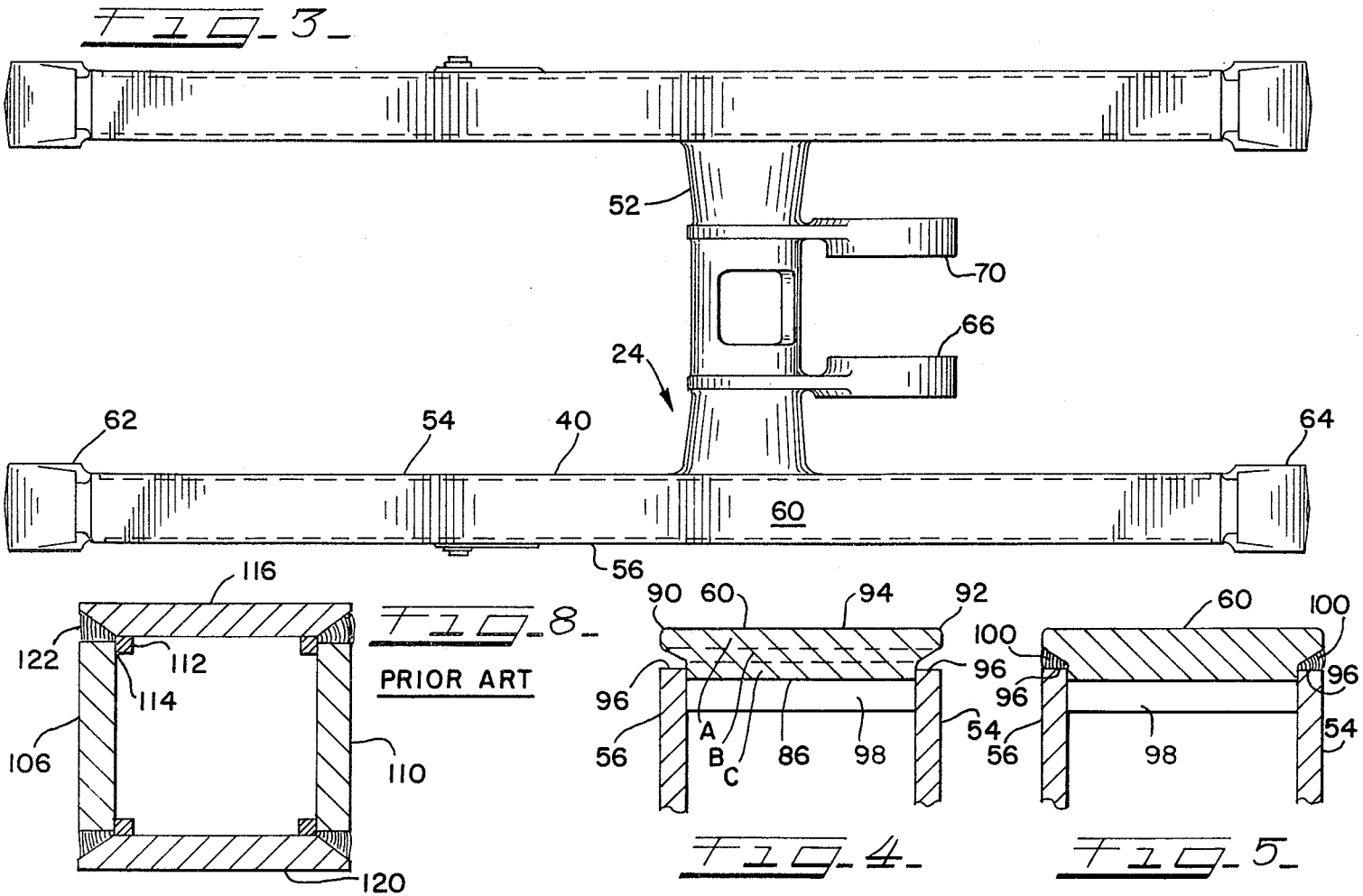
FIG. 3 is a top view of a loader boom incorporating the box section boom arm assembly of the invention.
FIG. 4 is a broken away portion of a box type boom arm as taken through plane 4—4 of FIG. 2.
FIG. 5 is a representation of the same section after welding.
FIG. 8 is a cross sectional view of a prior art boom arm box beam.

The boom assembly generally 24 should be understood to be an assembly having a pair of boom arms, one on each side of the bell crank assembly generally 50, connected together by a torque tube casting 52 as best seen in FIG. 3. FIG. 3 shows a boom arm 40 of a box type structure having an inboard side wall 54, and outboard side wall 56 and a top plate 60. A plurality of bottom plates enclose the bottom of the boom arm 40 but these are not shown in FIG. 3. The box sections of the boom arms terminate in castings 62 and 64 having through bores for allowing mounting of the boom assembly to the front frame section of the loader vehicle and to the bucket 30 respectively. Each casting 62 and 64 is formed with a sidewall contacting portion of a width equal to the width of the sidewall contacting portion of the top plate 60. An example is shown in FIG. 6 at 102 which is the weld bed of the boom pocket casting.

Each boom arm is connected to another to form the boom assembly generally 24. The torque tube casting 52 provides this connection while also providing a location for the bell crank pivot point. First 66 and second 70 bell crank pivot members are integral with the torque tube casting and are further provided with through bores to accommodate an axle or pivot pin for retaining the bell crank. In actual production it has been found to be expedient if the torque tube is cast as three pieces and later welded to a single unified structure as shown by 52.

Looking now to FIG. 2 where a side elevation view of a boom arm assembly is shown in an unwelded but assembled arrangement, the pertinent parts are shown. The torque tube casting 52 with the bell crank pivot member 66 is seen in a final position. A second boom arm would be behind the FIG. 2 representation but would not be seen in this view. A description of the single boom arm will suffice to explain the invention, however, it should be kept in mind that two boom arms are needed to make up a single boom arm assembly.

An outboard side wall 56 of the box section boom arm extends laterally from casting 62 to casting 64. A boom pocket casting 36 is eventually welded to the inboard and outboard 56 side walls and to a forward bottom plate 72 and a rear bottom plate 74. As can be seen in FIG. 1, the boom pocket casting 36 provides the rod and pivotal mounting point for the boom lifting cylinder 22. Aperture 76 is provided to receive a pivot pin while threaded aperture 80 is provided to accommodate a pin securing retaining bolt. The boom pocket casting is located between the end casting 62 and the torque tube casting 52. More definitively, the center point of the aperture 76 of the boom pocket casting 36 is generally an equal distance from the center point 82 of the bell crank pivot member 66 and the center point 84 of the boom end casting 62.

The outboard or first side wall 56 as well as the inboard or second side wall, not seen in FIG. 2, is a flat plate having an upper and a lower edge straight cut such that the plane of the edge is perpendicular to the surfaces of the plate as shown in FIGS. 4, 5, 6 and 7. The second side wall is spaced apart from and longitudinally aligned with the first side wall.

The top plate 60 is a continuous piece of material that is formed to complement and follow the curvalinear upper edge of the boom arm from boom arm end casting 62 to boom arm end casting 64. The transverse cross sectional shape of this top plate 60 is critical to the invention and can best be realized by looking at FIG. 4 where the inside surface 86 of the top plate 60 is shown positioned between the inboard surfaces of the outboard side wall 56 and the inboard side wall 54 while the extreme edges 90 and 92, adjacent the outboard surface 94, of the top plate lie substantially on the planes defined by the outer surfaces of the side walls 54 and 56. Looking only at the cross section of the top plate in FIG. 4, notice that the cross section is divided into three zones, the first zone identified as A having an edge perpendicular to the flat outboard surface of the top plate, a third zone identified as C where the edge is perpendicular to the flat inboard surface of the top plate and the edges are relatively inboard the edges in the first zone, and a second zone identified as B where the edges are beveled inwardly from the first zone edges to the third zone edges. The broken lines transversing this cross sectional view are provided only to show the demarkation line between zones. A plurality of transverse length dimensions are apparent from this cross section. The first zone has a transverse length dimension equal to an external first side wall to second side wall length of the finished box beam boom arm while the third zone C has a transverse length dimension equal to an internal first side wall to second side wall length of a finished box beam boom arm. The second zone, zone B, which is the zone between zones A and C, has a transverse length dimension that decreases from the value of the first zone transverse length dimension at its juncture with the second zone to a length dimension equal to the third zone's length dimension where the third zone meets the second zone. The bottom plate is formed with a cross sectional shape identical to that of the top plate's shape.

Just looking at each edge of the top and the bottom plates notice that the edges are stepped down from the outboard surface (i.e. the top surface of the top plate and the bottom surface of the bottom plate) to the inboard surface of the plates. Each edge has a first flat portion perpendicular to the flat outboard surface that extends part way toward the inboard surface. A second flat portion is perpendicular to the flat inboard surface and extends toward the first flat portion. The edges of the second flat portion are relatively inboard of the first flat portion. A beveled surface extends from the relatively inboard second flat portion to the first flat portion of the plate edge.

Item 98 is a prewelding locating strip that is tack welded to the inboard sides of the side walls to hold the side walls in aligned position during fabrication. A plurality of locating strips are used in each boom arm to ensure proper side wall alignment. Although the primary purpose of the locating strips is as described, a second utility can be realized by these strips. A secondary purpose of these strips would be to set the depth that the top plate could be inserted between the side walls.

In FIG. 4 a J-groove weld bed 96 is defined by the edges of the side wall, the edges of the top plate in the third zone and the bevel of the second zone of the top plate. The weld bed 96 is also shown in FIG. 2.

In FIG. 5 the J-groove weld bed 96 has been filled with welds 100 to positively connect the side walls 54 and 56 to the top plate 60.

FIGS. 6 and 7 show a similar type J-groove weld bed 102 in "before" and "after" welding conditions where the boom pocket casting 36 is welded to the side walls, one shown as 56. In FIG. 7 the weld is shown fully filling the weld bed 102. The boom pocket casting is formed with a side wall contacting portion of a width equal to the width of the third zone of the top plate. A beveled or sloped portion then progresses outwardly to a side portion that will share the plane of the side walls. When the weld 104 fills the weld bed 102 a relatively smooth transition between the side walls and the boom pocket casting is provided.

The casting at the boom arm ends, namely 62 and 64, are also formed with recessed perimeters where the boom arm ends meet the inboard and outboard side plates. With the side plates in position a J-groove is provided that is similar to the J-groove formed between the boom pocket casting and the side walls. The side walls are welded to the boom arm castings 62 and 64 to make a smooth transition between these components.

The forward bottom plate 72 and rear bottom plate 74 have cross sectional shapes exactly like the cross sectional shape of the top plate 60. Their assembly to the side walls is identical to the method of assembly used to attach the top plate 60 to the side walls 56 and 54.

The ends of the top plate 60 and the ends of the bottom plates may be straight cut as shown in FIG. 2 to provide a weld bed between the ends of the plates and the boom arm end castings 62 and 64 and between the ends of the bottom plates and the boom pocket casting.

The desirability of fabricating the box section boom arms in the method shown has been discussed above. However, a better understanding of why this uniquely shaped top plate and bottom plate cross sections provide the advantages enumerated can best be seen by comparing the prior art structure represented by FIG. 8 with the improved structure as shown in FIG. 5. In FIG. 8 the side walls 106 and 110 were provided with backup strips such as 112 that were first tack welded to the side walls around the periphery thereof and then welded at intersection 114 continuously along the length of the side walls at the top and the bottom of the side plates. The backup strips 112 had to be made of segmented sections, each having a curved shape matching the curved shape of portions of the side walls. The segmented sections of backup strips also had to be welded together to form a continuous backup strip. The exact positioning of the backup strip was necessary to ensure that weld blow through would not occur. Weld blow through is not a problem when the fabrication method of this invention is used as the third zone, zone C, of the top (or bottom) plate extends into the space between the side walls and is in contact with the side walls to close off any passage from the J-groove weld bed to the inside of the boom arm.

The top plate 116 and the bottom plate 120 were provided with beveled edges to form a weld bed between the edges of the side walls, the backup strip and the beveled edge of the top and bottom plates which was subsequently filled with a weld 122.

In the instant invention an alternative to conventional running bead type welding can be used. The alternative is to use an in situ welding technique where the boom arm is laid on its side such that the plane of the side wall is horizontal. The J-groove 96 is filled with powdered metal welding material and a welding electrode is passed through the powder which melts the powdered metal to fill up the J-groove. The boom arm is flipped over and the other side wall J-groove is then welded. The welding technique is well known in the art, however, the use of this technique in welding boom arms by others is unknown to the Applicant.

Thus it is apparent that there has been provided in accordance with the invention a boom arm assembly that fully satisfies the objects, aims and advantages set forth above. While the invention has been described in conjunction with specific embodiments thereof, it is evident that many alternatives, modifications and variations will be apparent to those skilled in the art in light of the foregoing description. For instance, the boom arm need not have the curvalinear elevation as shown, nor is it necessary that the boom pocket casting be located as specified. Alternative host vehicles may also advantageously use the described structure, a natural alternative would be a crawler tractor equipped loader. Accordingly, this disclosure is intended to embrace modifications and variations falling within the spirit of the appended claims.

What is claimed is:

1. A boom arm assembly for use on a loader vehicle comprising:

a pair of boom arms each boom arm comprising;

a first side wall having a curvalinear upper and a lower edge, said first side wall being a flat plate having said upper and lower edges straight cut such that a plane of each edge is perpendicular to a surface of said flat plate;

a second side wall having a curvalinear upper and a lower edge, said second sidewall being a flat plate having said curvalinear upper and said lower edge straight cut such that a plane of each edge is perpendicular to a surface of said flat plate, said second side wall spaced apart from and longitudinally aligned with said first side wall;

a top plate welded in position between said curvalinear upper edges of said first and second sidewalls to join said first and second sidewalls together, said top plate having a transverse cross sectional shape that has flat parallel inboard and outboard surfaces and edges that are stepped down from the outboard surface to the inboard surface of said top plate;

a pair of bottom plates, identified as forward and rear bottom plates, each welded in position between said lower edges of said first and second side walls to join them together, said bottom plates having a transverse cross sectional shape that has flat parallel inboard and outboard surfaces and edges that are stepped down from the outboard surface to the inboard surface of said bottom plates;

a first and a second boom arm end, one boom arm end welded to each of said box section boom arms, each boom arm end being a casting formed with a sidewall contacting portion forming a weld bed and, each boom arm end having a through bore;

a boom pocket casting formed with a sidewall contacting portion forming a weld bed welded to said lower edge of said first and second sidewalls between said forward and said rear bottom plates, said boom pocket casting having a through bore defining a centerpoint;

a torque tube casting connecting one of said pair of boom arms to the other of said pair of boom arms, said torque tube casting including a pair of bell crank pivot members each having a bore defining a centerpoint whereby said centerpoint of said boom pocket casting is generally an equal distance from said centerpoint of said first boom arm end and said centerpoint of said first boom arm end and said centerpoint of said bore of said bell crank pivot member.

* * * * *